United States Patent [19]

French

[11] 4,379,540

[45] Apr. 12, 1983

[54] ADJUSTABLE SUPPORT DEVICES FOR SWIVEL CHAIRS

[75] Inventor: John A. W. French, Milton Keynes, England

[73] Assignee: WIPAC Group Sales Limited, Buckingham, England

[21] Appl. No.: 193,305

[22] Filed: Oct. 2, 1980

[30] Foreign Application Priority Data

Oct. 6, 1979 [GB] United Kingdom ..... 7934765

[51] Int. Cl.[3] ..... F16M 11/00

[52] U.S. Cl. ..... 248/406

[58] Field of Search ..... 248/406, 405

[56] References Cited

U.S. PATENT DOCUMENTS

| | | | |
|---|---|---|---|
| 593,059 | 11/1897 | Sheriffs | 248/406 |
| 3,870,271 | 3/1975 | Bowman | 248/406 |
| 4,026,509 | 5/1977 | Wolters | 248/406 |
| 4,315,613 | 2/1982 | Godwin | 248/406 |

FOREIGN PATENT DOCUMENTS

| | | | |
|---|---|---|---|
| 7344833 | 7/1974 | France . | |
| 2210902 | 12/1974 | France | 248/406 |

*Primary Examiner*—William H. Schultz

*Attorney, Agent, or Firm*—Leydig, Voit, Osann, Mayer & Holt, Ltd.

[57] ABSTRACT

An adjustable support device for a swivel chair, comprises a swivel tube supported from a vertical rotatable screw by a nut. When the chair is unoccupied a spring-loaded friction clutch responsive to the weight acting on the screw restrains the screw against rotation so that the seat height can be adjusted by rotating the swivel tube which is attached to the seat part of the chair. When the chair is occupied, the clutch is released and the screw is freed for rotation with the tube so that swivelling movements of the seat part do not result in height adjustment, a continuous, but limited, frictional drag being applied between the screw and the nut to ensure that the screw and nut rotate as a unit when the clutch is released.

1 Claim, 1 Drawing Figure

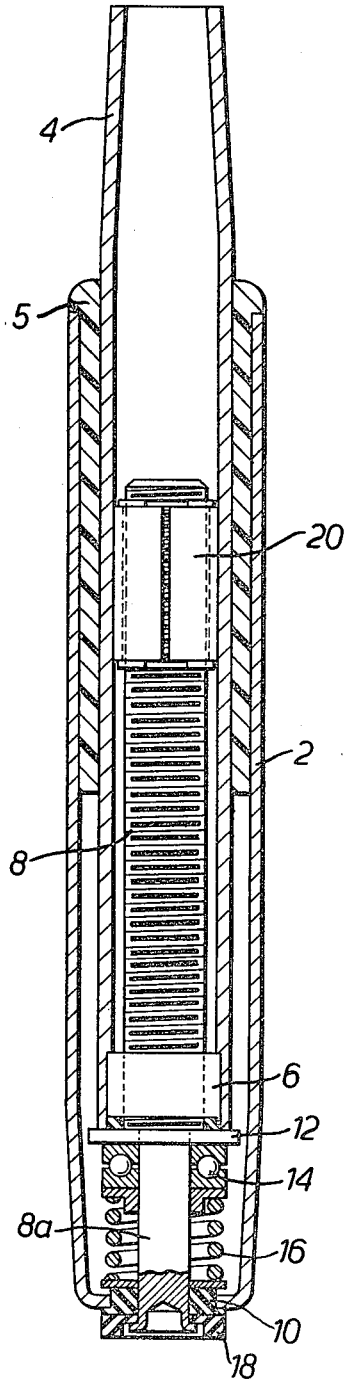
4
5
20
2
8
6
12
14
8a
16
10
18

ADJUSTABLE SUPPORT DEVICES FOR SWIVEL CHAIRS

BACKGROUND OF THE INVENTION

1. Field of the Invention

The present invention relates to adjustable support devices, and more particularly to adjustable support devices for typists and other swivel chairs of the type having a seat part which can be raised or lowered relative to a base part.

2. Description of the Prior Art

It is conventional in typists chairs to provide a seat part which is mounted above a base part by a supporting column which includes a screw-jack comprising a nut and a screw. The component parts of the screw-jack are secured respectively to the seat part and base part so that by rotation of the seat part the height of the seat can be raised or lowered. The disadvantage of this construction is that swivelling movement of the seat in use will also produce an unwanted increase or decrease in the seat height.

There has been proposed in British Patent Specification No. 647,183, a supporting column in which the nut and the screw are automatically locked together when the chair is occupied in order to prevent unwanted seat height adjustment from occuring. This effect is achieved by using a split nut which is clamped onto the screw under the loading acting on the column when the seat is occupied. The use of a split nut with means for clamping the nut onto the screw complicates the construction and is liable to fail in use.

SUMMARY OF THE INVENTION

According to the invention, there is provided an adjustable support device for a swivel chair, comprising a screw-jack assembly including a screw part and a nut part, said screw-jack assembly being mounted for rotational movement about a vertical axis coincident with the axis of the screw part, means for supporting the seat part of the chair from the screw-jack assembly, means operative, when no loading is applied to the screw-jack assembly by the weight of the occupant of the chair, to prevent rotation of one of said parts of the screw-jack assembly so that rotational movement of the supporting means causes rotation of the other of said parts of the screw-jack assembly with respect to said one part to thereby change the height of the seat part, and means for applying a continuous but limited friction between said parts of the screw-jack assembly whereby to cause the said parts to rotate as a unit when the chair is occupied and the said one part is released for rotation whereby rotation of the supporting means does not result in a change of height of the seat part.

Further according to the invention, there is provided an adjustable support device for a swivel chair comprising a screw member arranged, in use, to extend substantially vertically, a nut member mounted on said screw member, said screw member and nut member each being rotatable, one of said members being arranged to support the seat part of the swivel chair from the other of said members, clutch means for restraining the said other member against rotation whereby to permit adjustment of the seat height when the said one member is rotated relative to the said other member, said clutch means being released in response to a vertical load applied to the said other member when the chair is occupied, and means for applying a continuous limited frictional drag between the screw member and the nut member such that when the clutch means is released the screw member and nut member can rotate as a unit without altering the height of the seat part.

Still further according to the invention, there is provided an adjustable support device for a swivel chair comprising inner and outer telescopic tubes having an axis arranged, in use, to extend vertically with the seat part of the chair mounted at the upper end of one of said tubes, said one tube being rotatable and the other tube being stationary, a screw mounted within the inner and outer tubes on the axis of the tubes, a nut rigid with the said one tube and engaged with the screw, said screw being mounted for rotation about its axis and for vertical movement, spring means biasing said screw into an upper limit position in which the screw is prevented from rotating whereby rotation of the nut relative to the screw in this position effects adjustment of the seat height, and means for applying a continuous but limited frictional drag between the screw and the nut, said drag being less than the force exerted on the screw to prevent rotation of the screw in the upper limit position, whereby when the screw is moved downwardly out of said upper limit position by the vertical load applied when the chair is occupied the screw and nut are caused by said frictional drag to rotate as a unit when the said one tube is swivelled.

BRIEF DESCRIPTION OF THE DRAWINGS

An embodiment of the invention will now be described, by way of example only, with reference to the accompanying diagrammatic drawing, the sole figure of which is a vertical section through a support device in accordance with the present invention.

DESCRIPTION OF THE PREFERRED EMBODIMENT

The support device in the drawing is in the form of a column comprising an outer tube 2 which is secured at its lower end to a base (not shown) of a chair, and an inner tube 4 which is secured at its upper end to the seat part (not shown) of the chair. A bush 5 of nylon or other suitable wear-resistant material is interposed between the tubes 2 and 4 to hold the tube 4 in centered relation to the tube 2.

The inner tube 4 is supported from the outer tube 2 by a height-varying screw assembly comprising a nut 6 secured into the lower end of the inner tube 4 and engaging a vertical screw 8 disposed on the axis of the column and mounted for limited axial movement relative to the outer tube 2, and also for rotational movement about its axis.

The mounting for the screw 8 comprises a friction washer 10 fixed into the lower end of the tube 2 and through which a reduced-diameter portion **8*a* of the screw 8 passes. A washer 12 secured to the screw 8 at the upper end of its reduced-diameter portion 8*a* forms an upper support face for a ball thrust bearing 14 disposed around the screw portion 8*a*. A compression coil spring 16 is interposed between the friction washer 10 and the bearing 14 and is operative to bias the screw 8 upwardly into an upper limit position in which a washer 18 carried at the lower end of the screw portion 8*a* abuts against the under-surface of the friction washer 10**.

A split sleeve 20 is mounted at the upper end portion of the screw 8 and is spring-biased into engagement with the inner surface of the tube 4, so as to exert limited frictional drag between the screw 8 and the tube 4, in a continuous and permanent manner.

The column operates as follows:

When the chair is unoccupied, the screw 8 is biased by the spring 16 into its upper limit position in which the washer 18 at the end of the screw portion 8*a* is in engagement with the friction washer 10, and a frictional drag is thereby exerted on the screw 8 to prevent rotation of the screw 8. The drag exerted on the screw 8 by the action of the washer 18 engaging the friction washer 10 is greater than the frictional drag exerted by the split sleeve 20 between the screw 18 and the tube 4, and therefore the tube 4 can be rotated relative to the screw 8, by rotating the seat part of the chair. Rotation of the tube 4 relative to the screw 8 will result in movement of the nut 6 along the screw 8, so that the height of the seat part can be adjusted.

When the chair is occupied, the weight of the occupant will cause the assembly formed by the tube 4 and the screw 8 to deflect downwardly against the bias of the spring 16, so that the washer 18 at the bottom of the screw portion 8*a* will move out of engagement with the friction washer 10, thereby freeing the screw 8 from the frictional drag which acted to prevent its rotation. In this condition, the tube 4 and the screw 8 will rotate as a unit due to the limited frictional drag imposed between the tube 4 and the screw 8 by the split sleeve 20, the bearing 14 acting as a rotational bearing for the tube/screw unit. Accordingly, when the chair is occupied, rotation of the seat part will not result in adjustment of the height, as no relative rotation occurs between the tube (and thereby the nut 6) and the screw 8.

In one practical example, the compression spring 16 is such that the tube/screw unit deflects downwardly at a force of about 100 lbs.

The mounting for the screw 8 acts, in effect, as a friction clutch which is engaged and released automatically according to whether the chair is unoccupied or occupied so as to hold the screw 8 against rotation, or to release the screw 8 for rotation. If, during adjustment of the seat height, the nut 6 is screwed into either of its two end positions on the screw, excessive tightening of the nut on the screw, and possible damage to the screw head, will be prevented as the clutch will start to slip when the drag exerted by the nut on the screw exceeds that exerted by the friction washer.

I claim:

1. In an adjustable support device for a swivel chair, of the type comprising inner and outer telescopic tubes having an axis arranged, in use, to extend vertically with the seat part of the chair mounted at the upper end of one of said tubes, said one tube being rotatable and the other tube being stationary, bearing means, a screw rotatably mounted within the inner and outer tubes on the axis of the tubes by said bearing means which permits the screw to rotate about a vertical axis, a nut rigid with the said one tube and engaged with the screw, said screw being mounted for vertical movement, spring means biasing said screw into an upper limit position, and friction clutch means comprising a first friction member carried by the screw, and a second, stationary, friction member, said first friction member engaging said second friction member in the upper limit position of the screw in order to prevent the screw from rotating whereby rotation of the nut relative to the screw in this position effects adjustment of the seat height, and said clutch means being released by downwards movement of the screw from its upper limit position by a vertical load applied when the chair is occupied, the improvement comprising a drag-applying member mounted on the screw and resiliently engaging the interior surface of the said one tube to apply a continuous but limited frictional drag between the screw and the nut, said drag being less than the force exerted by the engaged friction members of the clutch means to prevent rotation of the screw in the upper limit position, but said drag being sufficient to ensure that the screw and the nut rotate as a unit when the said one tube is swivelled with the chair occupied, the drag-applying member being of annular section and being interposed between the screw and the said one tube, and being split axially to provide the resilient bias.

* * * * *